US010551757B2

(12) United States Patent
Yabuki

(10) Patent No.: US 10,551,757 B2
(45) Date of Patent: Feb. 4, 2020

(54) MAGENTA TONER FOR DEVELOPING ELECTROSTATIC IMAGES

(71) Applicant: ZEON CORPORATION, Tokyo (JP)

(72) Inventor: Nozomi Yabuki, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 16/087,263

(22) PCT Filed: Mar. 22, 2017

(86) PCT No.: PCT/JP2017/011431
§ 371 (c)(1),
(2) Date: Sep. 21, 2018

(87) PCT Pub. No.: WO2017/170030
PCT Pub. Date: Oct. 5, 2017

(65) Prior Publication Data

US 2019/0101842 A1 Apr. 4, 2019

(30) Foreign Application Priority Data

Mar. 30, 2016 (JP) ..... 2016-067263

(51) Int. Cl.
*G03G 9/09* (2006.01)
*G03G 9/097* (2006.01)
*G03G 9/08* (2006.01)

(52) U.S. Cl.
CPC ..... *G03G 9/0926* (2013.01); *G03G 9/09725* (2013.01); *G03G 9/0808* (2013.01); *G03G 9/0819* (2013.01)

(58) Field of Classification Search
CPC ..... G03G 9/0926; G03G 9/09725; G03G 9/0819; G03G 9/0808
See application file for complete search history.

(56) References Cited

U.S. PATENT DOCUMENTS

| | | | |
|---|---|---|---|
| 2003/0207191 | A1 | 11/2003 | Kadota |
| 2009/0035683 | A1 | 2/2009 | Imafuku et al. |
| 2009/0052952 | A1 | 2/2009 | Katoh et al. |
| 2013/0196261 | A1 | 8/2013 | Uchinokura et al. |
| 2014/0220485 | A1 | 8/2014 | Kojima et al. |

FOREIGN PATENT DOCUMENTS

| | | | |
|---|---|---|---|
| JP | 2002202622 | A | 7/2002 |
| JP | 2007-72350 | A | 3/2007 |
| JP | 2009036980 | A | 2/2009 |
| JP | 2009-53240 | A | 3/2009 |
| JP | 2013-156430 | A | 8/2013 |
| JP | 2014-41238 | A | 3/2014 |
| JP | 2014-153409 | A | 8/2014 |
| JP | 2014164034 | A | 9/2014 |

OTHER PUBLICATIONS

English translation of Notification of Transmittal of Translation of the International Preliminary Report on Patentabililty (Form PCT/IB/338) issued in counterpart International Application No. PCT/JP2017/011431 dated Oct. 11, 2018 with Forms PCT/IB/373 and PCT/ISA/237 (8 pages).

*Primary Examiner* — Thorl Chea
(74) *Attorney, Agent, or Firm* — Westerman, Hattori, Daniels & Adrian, LLP

(57) ABSTRACT

The magenta toner for developing electrostatic images includes colored resin particles containing a binder resin and a magenta colorant, and an external additive. A volume average particle diameter of the colored resin particles is from 5.5 μm to 7.0 μm. The external additive contains silica particles. The silica particles contain at least silica particles A having a number average particle diameter of from 5 nm to 30 nm and silica particles B having a number average particle diameter of from 31 nm to 100 nm; wherein a total content of the silica particles is from 0.5 part by mass to 4.5 parts by mass, with respect to 100 parts by mass of the colored resin particles. A liberation rate of the silica particles calculated by a specific liberation rate measuring method is in a range of from 2.2% to 9.5%.

3 Claims, No Drawings

MAGENTA TONER FOR DEVELOPING ELECTROSTATIC IMAGES

TECHNICAL FIELD

The present invention relates to a magenta toner for developing electrostatic images, which is configured to inhibit toner ejection and occurrence of fog under a high-temperature and high-humidity environment.

BACKGROUND ART

In an image forming device such as an electrophotographic device and an electrostatic recording device, first, an electrostatic latent image formed on the photoconductor is developed by a toner. Next, as needed, the thus-formed toner image is transferred onto a transfer material such as a paper and then fixed by various methods such as heating, applying pressure, and solvent fume.

The above-mentioned toner obtains desired flowability and charging characteristics by attaching an external additive to the surface of colored resin particles. As the external additive, fine particles composed of an inorganic or organic material are widely and generally used.

A toner is disclosed in Patent Literature 1, which is characterized in that the liberation rate of liberated mother particles to which silica is not attached, is set to be 10% or less, and the liberation rate of liberated silica, which is silica that is not attached to the mother particles, is set to be 0.2% to 10%. Also, Patent Literature 1 describes that the toner can improve low-temperature fixability, with preventing toner filming on toner-contact members.

CITATION LIST

Patent Literature 1: Japanese Patent Application Laid-Open No. 2002-202622

SUMMARY OF INVENTION

Technical Problem

However, the toner disclosed in Patent Literature 1 has the following problem: the toner is deteriorated and ejected from a toner cartridge, while it is in the state of being packed in the cartridge. In addition, the toner has printing quality problems such as the ease of fog occurrence under a high-temperature and high-humidity environment.

The present invention was achieved in light of the above circumstance. An object of the present invention is to provide a magenta toner for developing electrostatic images, which is configured to inhibit toner ejection from a cartridge and occurrence of fog under a high-temperature and high-humidity environment.

Solution to Problem

The magenta toner for developing electrostatic images according to the present invention, is a toner for developing electrostatic images, comprising colored resin particles containing a binder resin and a magenta colorant, and an external additive, wherein a volume average particle diameter of the colored resin particles is from 5.5 μm to 7.0 μm; wherein the external additive contains silica particles; wherein the silica particles contain at least silica particles A having a number average particle diameter of from 5 nm to 30 nm and silica particles B having a number average particle diameter of from 31 nm to 100 nm; wherein a total content of the silica particles is from 0.5 part by mass to 4.5 parts by mass, with respect to 100 parts by mass of the colored resin particles; and wherein a liberation rate of the silica particles calculated by the following liberation rate measuring method is in a range of from 2.2% to 9.5%.

[Liberation Rate Measuring Method]

Using an airflow classifier, a toner to be measured is classified to separate liberated silica particles from the toner; using a X-ray fluorescence spectrometer, a fluorescent X-ray intensity of a Si element in the toner before the classification and that of the Si element in the toner after the classification, are measured; and using measured values thus obtained, a liberation rate of the silica particles in the toner is calculated by the following formula (1):

The liberation rate of the silica particles=[(the fluorescent X-ray intensity of the Si element in the toner before the classification−the fluorescent X-ray intensity of the Si element in the toner after the classification)/the fluorescent X-ray intensity of the Si element in the toner before the classification]×100 Formula (1)

In the present invention, a content of the silica particles A is preferably from 0.1 part by mass to 2.0 parts by mass, with respect to 100 parts by mass of the colored resin particles.

In the present invention, a content of the silica particles B is preferably from 0.3 part by mass to 2.5 parts by mass, with respect to 100 parts by mass of the colored resin particles.

Advantage Effects of Invention

According to the present invention, the magenta toner for developing electrostatic images can be provided, which is configured to inhibit toner ejection from a toner cartridge and occurrence of fog under a high-temperature and high-humidity environment.

DESCRIPTION OF EMBODIMENTS

The magenta toner for developing electrostatic images according to the present invention, is a toner for developing electrostatic images, comprising colored resin particles containing a binder resin and a magenta colorant, and an external additive, wherein a volume average particle diameter of the colored resin particles is from 5.5 μm to 7.0 μm; wherein the external additive contains silica particles; wherein the silica particles contain at least silica particles A having a number average particle diameter of from 5 nm to 30 nm and silica particles B having a number average particle diameter of from 31 nm to 100 nm; wherein a total content of the silica particles is from 0.5 part by mass to 4.5 parts by mass, with respect to 100 parts by mass of the colored resin particles; and wherein a liberation rate of the silica particles calculated by the following liberation rate measuring method is in a range of from 2.2% to 9.5%.

[Liberation Rate Measuring Method]

Using an airflow classifier, a toner to be measured is classified to separate liberated silica particles from the toner; using a X-ray fluorescence spectrometer, a fluorescent X-ray intensity of a Si element in the toner before the classification and that of the Si element in the toner after the classification, are measured; and using measured values thus obtained, a liberation rate of the silica particles in the toner is calculated by the following formula (1):

The liberation rate of the silica particles=[(the fluorescent X-ray intensity of the Si element in the toner before the classification−the fluorescent X-ray intensity of the Si element in the toner after the classification)/the fluorescent X-ray intensity of the Si element in the toner before the classification]×100 Formula (1)

Hereinafter, the magenta toner for developing electrostatic images (hereinafter it may be simply referred to as "toner") of the present invention will be described.

The toner of the present invention comprises colored resin particles containing a binder resin and a magenta colorant, and an external additive.

Hereinafter, a method for producing colored resin particles used in the present invention, the colored resin particles obtained by the production method, a method for producing the toner of the present invention using the colored resin particles, and the toner of the present invention will be described in this sequence.

1. Method for Producing Colored Resin Particles

In general, methods for producing colored resin particles are broadly classified into dry methods such as a pulverization method and wet methods such as an emulsion polymerization agglomeration method, a suspension polymerization method and a solution suspension method. Wet methods are preferred since toners having excellent printing properties such as image reproducibility can be easily obtained. Among wet methods, polymerization methods such as an emulsion polymerization agglomeration method and a suspension polymerization method are preferred, since toners having a relatively small particle size distribution on a micron scale, can be easily obtained. Among polymerization methods, a suspension polymerization method is more preferred.

The emulsion polymerization agglomeration method is a method for producing colored resin particles by polymerizing emulsified polymerizable monomers to obtain a resin microparticle emulsion, and aggregating the resulting resin microparticles with a colorant dispersion, etc. The solution suspension method is a method for producing colored resin particles by forming a solution into droplets in an aqueous medium, the solution containing toner components such as a binder resin and a colorant dissolved or dispersed in an organic solvent, and removing the organic solvent. Both methods can be carried out by known methods.

The colored resin particles according to the present invention can be produced by employing the wet method or the dry method. In the case of producing the colored resin particles by (A) the suspension polymerization method, which is preferred among the wet methods, or by (B) the pulverization method, which is typical among the dry methods, the production is carried out by the following processes.

(A) Suspension Polymerization Method (A-1) Preparation Process of Polymerizable Monomer Composition First, a polymerizable monomer, a colorant and other additives added as needed, such as a release agent and a charge control agent, are mixed to prepare a polymerizable monomer composition. For example, a media type dispersing machine is used for the mixing in the preparation of the polymerizable monomer composition.

In the present invention, the polymerizable monomer means a monomer having a polymerizable functional group, and the polymerizable monomer is polymerized into a binder resin. As a main component of the polymerizable monomer, a monovinyl monomer is preferably used. As the monovinyl monomer, examples include styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; amide compounds such as acrylamide and methacrylamide; and olefins such as ethylene, propylene and butylene. These monovinyl monomers may be used alone or in combination of two or more kinds.

Of the monovinyl monomers, styrene, styrene derivatives, acrylic acid esters and methacrylic acid esters are preferably used.

To improve the storage stability (blocking resistance) of the toner, it is preferable to use a crosslinkable polymerizable monomer as a part of the polymerizable monomer, together with the monovinyl monomer. The crosslinkable polymerizable monomer means a monomer having two or more polymerizable functional groups. As the crosslinkable polymerizable monomer, examples include aromatic divinyl compounds such as divinyl benzene, divinyl naphthalene and derivatives thereof; ethylenically unsaturated carboxylic acid esters such as ethylene glycol dimethacrylate and diethylene glycol dimethacrylate; divinyl compounds such as N,N-divinylaniline and divinyl ether; and compounds having three or more vinyl groups, such as trimethylolpropane trimethacrylate and dimethylolpropane tetraacrylate. These crosslinkable polymerizable monomers may be used alone or in combination of two or more kinds.

In the present invention, the amount of the crosslinkable polymerizable monomer used is generally from 0.1 part by mass to 5 parts by mass, and preferably from 0.3 part by mass to 2 parts by mass, with respect to 100 parts by mass of the monovinyl monomer.

Also, to improve the balance between the storage stability and low-temperature fixability of the toner, it is preferable to use a macromonomer as a part of the polymerizable monomer, together with the monovinyl monomer. The macromonomer means a reactive oligomer or polymer having a polymerizable carbon-carbon unsaturated bond at the end of a polymer chain and generally having a number average molecular weight (Mn) of from 1,000 to 30,000. As the macromonomer, it is preferable to use an oligomer or polymer having a higher glass transition temperature (Tg) than a polymer (binder resin) obtained by polymerizing the polymerizable monomer.

In the present invention, the amount of the macromonomer used can be generally from 0.01 part by mass to 10 parts by mass, preferably from 0.03 part by mass to 5 parts by mass, and more preferably from 0.1 part by mass to 2 parts by mass, with respect to 100 parts by mass of the monovinyl monomer.

In the present invention, the magenta colorant is used as a colorant.

As the magenta colorant, for example, azo-based pigments such as a monoazo pigment and a disazo pigment, and compounds such as a condensed polycyclic pigment may be used. As the magenta colorant, examples include C.I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255 and 269, and C.I. Pigment Violet 19.

In the present invention, these magenta colorants can be used alone or in combination of two or more kinds. The amount of the colorant is preferably from 1 part by mass to 15 parts by mass, with respect to 100 parts by mass of the monovinyl monomer.

To increase the removability of the toner from a fixing roller, a release agent is preferably used as another additive.

The release agent is not particularly limited, as long as it is one that is generally used as a release agent for toners. As the release agent, examples include polyolefin waxes such as low-molecular-weight polyethylene, low-molecular-weight polypropylene and low-molecular-weight polybutylene; natural waxes such as candelilla, carnauba, rice, Japan wax and jojoba; petroleum waxes such as paraffin, microcrystalline and petrolatum; mineral waxes such as montan, ceresin and ozokerite; synthetic waxes such as Fischer-Tropsch wax; monoalcohol ester compounds such as stearyl stearate, stearyl behenate, behenyl stearate and behenyl behenate; and polyhydric alcohol ester compounds including pentaerythritol esters such as pentaerythritol tetramyristate, pentaerythritol tetrapalmitate, pentaerythritol tetrastearate and pentaerythritol tetralaurate, and dipentaerythritol esters such as dipentaerythritol hexamyristate, dipentaerythritol hexapalmitate and dipentaerythritol hexalaurate. These release agents may be used alone or in combination of two or more kinds.

In the present invention, the amount of the release agent used is generally from 0.1 part by mass to 30 parts by mass, and preferably from 1 part by mass to 20 parts by mass, with respect to 100 parts by mass of the monovinyl monomer. When the amount is small, the toner may not obtain sufficient releasability. On the other hand, when the amount is large, the storage stability of the toner may decrease.

To increase the charge property of the toner, a positively- or negatively-chargeable charge control agent can be used as another additive.

The charge control agent is not particularly limited, as long as it is one that is generally used as a charge control agent for toners. Of charge control agents, a positively- or negatively-chargeable charge control resin is preferred, since it has high compatibility with polymerizable monomers and can impart stable charge property (charge stability) to the toner particles. From the viewpoint of obtaining a positively-chargeable toner, a positively-chargeable charge control resin is more preferably used.

As the positively-chargeable charge control agent, examples include a nigrosine dye, a quaternary ammonium salt, a triaminotriphenylmethane compound, an imidazole compound, a polyamine resin, which is a charge control resin that is preferably used, a quaternary ammonium group-containing copolymer, and a quaternary ammonium base-containing copolymer.

As the negatively-chargeable charge control agent, examples include azo dyes containing metals such as Cr, Co, Al and Fe; a metal salicylate compound and a metal alkyl salicylate compound; and a sulfonic acid group-containing copolymer, a sulfonic acid base-containing copolymer, a carboxylic acid group-containing copolymer and a carboxylic acid base-containing copolymer, which are charge control resins that are preferably used.

In the present invention, the amount of the charge control agent used is generally from 0.01 part by mass to 10 parts by mass, and preferably from 0.03 part by mass to 8 parts by mass, with respect to 100 parts by mass of the monovinyl monomer. When the added amount of the charge control agent is less than 0.01 part by mass, fog may occur. On the other hand, when the added amount of the charge control agent is more than 10 parts by mass, soiling may occur.

A molecular weight modifier is preferably used as another additive.

The molecular weight modifier is not particularly limited, as long as it is one that is generally used as a molecular weight modifier for toners. As the molecular weight modifier, examples include mercaptans such as t-dodecyl mercaptan, n-dodecyl mercaptan, n-octyl mercaptan and 2,2,4,6,6-pentamethylheptane-4-thiol, and thiuram disulfides such as tetramethyl thiuram disulfide, tetraethyl thiuram disulfide, tetrabutyl thiuram disulfide, N,N'-dimethyl-N,N'-diphenyl thiuram disulfide, and N,N'-dioctadecyl-N,N'-diisopropyl thiuram disulfide. These molecular weight modifiers may be used alone or in combination of two or more kinds.

In the present invention, the amount of the molecular weight modifier used is generally from 0.01 part by mass to 10 parts by mass, and preferably from 0.1 part by mass to 5 parts by mass, with respect to 100 parts by mass of the monovinyl monomer.

(A-2) Suspension Process of Obtaining Suspension (Droplets Forming Process)

The polymerizable monomer composition obtained through the above-mentioned "(A-1) Preparation process of polymerizable monomer composition" is suspended in an aqueous dispersion medium to obtain a suspension (a polymerizable monomer composition dispersion). As used herein, "suspend" means forming the polymerizable monomer composition into droplets in the aqueous dispersion medium. For the droplets formation, a dispersion treatment can be carried out by means of a device capable of strong agitation, such as an in-line type emulsifying and dispersing machine (product name: MILDER, manufactured by: Pacific Machinery & Engineering Co., Ltd.) and a high-speed emulsifying/dispersing machine (product name: T. K. HOMOMIXER MARK II, manufactured by: Tokushu Kika Kogyo Co., Ltd.)

In the droplets formation of the present invention, a dispersion stabilizer is preferably contained and used in the aqueous dispersion medium, in order to control the particle diameter of the colored resin particles and improve the circularity thereof.

The aqueous dispersion medium may be simply water, or water can be used in combination with a water-soluble solvent such as lower alcohol and lower ketone.

As the dispersion stabilizer, examples include sulfates such as barium sulfate and calcium sulfate; carbonates such as barium carbonate, calcium carbonate and magnesium carbonate; phosphates such as calcium phosphate; metal compounds including metal oxides such as aluminum oxide and titanium oxide, and metal hydroxides such as aluminum hydroxide, magnesium hydroxide and iron(II)hydroxide; water-soluble polymer compounds such as polyvinyl alcohol, methyl cellulose and gelatin; and organic polymer compounds such as an anionic surfactant, a nonionic surfactant and an ampholytic surfactant.

Of dispersion stabilizers, a dispersion stabilizer containing a colloid of a hardly water-soluble metal hydroxide (a hardly water-soluble inorganic compound) soluble in acid solution, is preferably used. These dispersion stabilizers can be used alone or in combination of two or more kinds.

The added amount of the dispersion stabilizer is preferably from 0.1 part by mass to 20 parts by mass, and more preferably from 0.2 part by mass to 10 parts by mass, with respect to 100 parts by mass of the polymerizable monomer.

As the polymerization initiator used for polymerization of the polymerizable monomer composition, examples include inorganic persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-hexylperoxy-2-ethylhexanoate, t-butylperoxypivalate, diisopropylperoxydicarbonate, di-t-butylperoxyisophthalate, t-butylperoxy-2-ethylbutanoate, t-butylperoxy-2-methylbutanoate, t-hexylperoxyisobutyrate and t-butylperoxyisobutyrate. Of them, organic peroxides are preferably used. In the case of using them, a toner that provides less odor and excellent image quality can be obtained.

The polymerization initiator may be directly added to the polymerizable monomer composition, or it may be added at the stage after the polymerizable monomer composition is dispersed in the aqueous dispersion medium containing the dispersion stabilizer and before the polymerizable monomer composition is formed into droplets.

The added amount of the polymerization initiator is preferably from 0.1 part by mass to 20 parts by mass, more preferably from 0.3 part by mass to 15 parts by mass, and even more preferably from 1.0 part by mass to 10 parts by mass, with respect to 100 parts by mass of the monovinyl monomer. When the amount is small, the fixability of the toner may decrease. On the other hand, when the amount is large, the storage stability of the toner may decrease.

(A-3) Polymerization Process

The desired suspension (the aqueous dispersion medium containing the droplets of the polymerizable monomer composition) obtained by the above "(A-2) Suspension process of obtaining suspension (droplets forming process)" is polymerized by heating, thereby obtaining an aqueous dispersion of colored resin particles.

In the present invention, the polymerization temperature is preferably 50° C. or more, and more preferably from 60° C. to 98° C. Also in the present invention, the polymerization time is preferably from 1 hour to 20 hours, and more preferably from 2 hours to 15 hours.

To carry out the polymerization in the state that the droplets of the polymerizable monomer composition are stably dispersed, the polymerization reaction may be further promoted in this polymerization process, following the above "(A-2) Suspension process of obtaining suspension (droplets forming process)", with carrying out the dispersion treatment by agitation.

In the present invention, it is preferable that the colored resin particles are so-called core-shell type (or "capsule type") colored resin particles obtained by using the colored resin particles obtained by the polymerization process as a core layer and forming a shell layer, which is a layer different from the core layer, around the core layer.

By covering the core layer composed of a substance having a low softening point with a substance having a higher softening point, the core-shell type colored resin particles can achieve a balance between lowering of toner fixing temperature and prevention of toner aggregation during storage.

The method for producing the core-shell type colored resin particles is not particularly limited. The core-shell type colored resin particles can be produced by conventional methods. The in situ polymerization method and the phase separation method are preferred from the viewpoint of production efficiency.

Hereinafter, a method for producing the core-shell type colored resin particles by the in situ polymerization method, will be described.

The core-shell type colored resin particles can be obtained by adding a polymerizable monomer for forming a shell layer (a polymerizable monomer for shell) and a polymerization initiator to the aqueous medium in which the colored resin particles are dispersed, and then polymerizing the mixture.

As the polymerizable monomer for shell, the above-mentioned polymerizable monomers can be used. Of them, it is preferable to use monomers that can provide a polymer having a Tg of more than 80° C., such as styrene and methyl methacrylate, alone or in combination of two or more kinds.

As the polymerization initiator for shell used for polymerization of the polymerizable monomer for shell, examples include polymerization initiators including persulfates such as potassium persulfate and ammonium persulfate, and water-soluble azo compounds such as 2,2'-azobis(2-methyl-N-(2-hydroxyethyl)propionamide) and 2,2'-azobis(2-methyl-N-(1,1-bis(hydroxymethyl)2-hydroxyethyl)propionamide).

The added amount of the polymerization initiator for shell used in the present invention, is preferably from 0.1 part by mass to 30 parts by mass, and more preferably from 1 part by mass to 20 parts by mass, with respect to 100 parts by mass of the polymerizable monomer for shell.

The polymerization temperature of the shell layer is preferably 50° C. or more, and more preferably from 60° C. to 95° C. The polymerization reaction time is preferably from 1 hour to 20 hours, and more preferably from 2 hours to 15 hours.

(A-4) Washing, Filtering, Dehydrating and Drying Processes

It is preferable that the aqueous dispersion of the colored resin particles obtained after the above "(A-3) Polymerization process" is repeatedly subjected to a series of washing, filtering, dehydrating and drying processes, several times as needed, according to a conventional method.

First, for removal of the dispersion stabilizer remaining in the aqueous dispersion of the colored resin particles, washing is carried out by adding acid or alkali to the aqueous dispersion of the colored resin particles.

When the dispersion stabilizer used is an acid-soluble inorganic compound, acid is added to the aqueous dispersion of the colored resin particles. When the dispersion stabilizer used is an alkali-soluble inorganic compound, alkali is added to the aqueous dispersion of the colored resin particles.

When the acid-soluble inorganic compound is used as the dispersion stabilizer, it is preferable to control the pH of the aqueous dispersion of the colored resin particles to 6.5 or less by adding acid. It is more preferable to control the pH to 6 or less. As the acid, inorganic acids such as sulfuric acid, hydrochloric acid and nitric acid, and organic acids such as formic acid and acetic acid, can be used. Sulfuric acid is particularly preferred for its high efficiency of removal of the dispersion stabilizer and small impact on production facilities.

(B) Pulverization Method

In the case of producing the colored resin particles by employing the pulverization method, the colored resin particles are produced by the following processes.

First, a binder resin, a magenta pigment and other additives added as needed, such as a charge control agent and a release agent, are mixed by means of a mixer such as a ball mill, a V-type mixer, FM MIXER (product name), a high-speed dissolver or an internal mixer. Next, while heating the thus-obtained mixture, the mixture is kneaded by means of a press kneader, a twin screw kneading machine, a roller or the like. The thus-obtained kneaded product is coarsely pulverized by means of a pulverizer such as a hammer mill, a cutter mill or a roller mill, finely pulverized by means of a pulverizer such as a jet mill or a high-speed rotary pulverizer, and then classified into particles having a desired particle diameter by means of a classifier such as an air classifier and an airflow classifier, thereby obtaining colored resin particles produced by the pulverization method.

As the binder resin, the magenta pigment and the other additives added as needed (such as the charge control agent and the release agent), those that are provided under the above "(A) Suspension polymerization method" can be used in the pulverization method. Similarly to the colored resin particles obtained by the above "(A) Suspension polymerization method", the colored resin particles obtained by the pulverization method can be made into core-shell type colored resin particles by a method such as the in situ polymerization method.

As the binder resin, resins that have been widely used for toners can be used. As the binder resin used in the pulverization method, examples include polystyrene, styrene-butyl acrylate copolymers, polyester resins and epoxy resins.

2. Colored Resin Particles

The colored resin particles are obtained by the production method such as the above-mentioned "(A) Suspension polymerization method" or "(B) Pulverization method".

Hereinafter, the colored resin particles constituting the toner of the present invention will be described. The colored resin particles described below encompass both core-shell type colored resin particles and colored resin particles of other types.

The volume average particle diameter (Dv) of the colored resin particles is from 5.5 μm to 7.0 μm, preferably from 5.6 μm to 6.7 μm, and more preferably from 5.7 μm to 6.4 μm.

When the volume average particle diameter Dv of the colored resin particles is below the range, the flowability of the toner decreases. As a result, image quality deterioration due to fog, etc., is likely to occur and may have adverse effects on printing performance. On the other hand, when the volume average particle diameter Dv of the colored resin particles is above the range, the resolution of an image thus obtained is likely to decrease and may have adverse effects on printing performance.

The ratio between the volume average particle diameter Dv and number average particle diameter Dn of the colored resin particles, that is, the particle size distribution Dv/Dn of the colored resin particles is preferably from 1.00 to 1.30, more preferably from 1.00 to 1.25, and even more preferably from 1.00 to 1.20, from the viewpoint of image reproducibility.

When the particle size distribution Dv/Dn of the colored resin particles is above the range, the flowability of the toner decreases. As a result, image quality deterioration due to fog, etc., is likely to occur and may have adverse effects on printing performance.

The volume average particle diameter Dv and number average particle diameter Dn of the colored resin particles are values measured by means of a particle diameter measuring machine.

As the method for measuring the volume average particle diameter Dv and the method for calculating the particle size distribution Dv/Dn, the following method can be exemplified. The Dv measuring method and the Dv/Dn calculating method are not limited to the following method.

First, 0.1 g of the colored resin particles are taken and put in a beaker. As a dispersant, 0.1 mL of an alkylbenzene sulfonic acid aqueous solution (product name: DRIWEL, manufactured by: Fujifilm Corporation) is added thereto. In addition, 10 mL to 30 mL of ISOTON II (product name, manufactured by: Beckman Coulter, Inc.) is added to the beaker. The colored resin particles are dispersed for 3 minutes by a 20 W (watt) ultrasonic disperser. Then, by means of a particle diameter measuring machine (product name: MULTISIZER, manufactured by: Beckman Coulter, Inc.), the volume average particle diameter Dv and number average particle diameter Dn of the colored resin particles are measured in the following conditions, and the particle size distribution Dv/Dn is calculated.

Aperture diameter: 100 μm

Medium: ISOTON II

Number of measured particles: 100,000 particles

3. Method for Producing the Toner

In the present invention, the colored resin particles are mixed and stirred with an external additive to attach the external additive to the surface of the colored resin particles, thereby obtaining a one-component toner (developer). The one-component toner may be mixed and stirred with carrier particles to obtain a two-component developer.

An agitator is used for the attachment, and the agitator is not particularly limited, as long as it is an agitating device that can attach the external additive to the surface of the colored resin particles. For example, the attachment can be carried out by means of an agitator that is capable of mixing and agitation, such as FM MIXER (product name, manufactured by: Nippon Coke & Engineering Co., Ltd.), SUPER MIXER (product name, manufactured by: Kawata Manufacturing Co., Ltd.), Q MIXER (product name, manufactured by: Nippon Coke & Engineering Co., Ltd.), MECHANOFUSION SYSTEM (product name, manufactured by: Hosokawa Micron Corporation) and MECHANOMILL (product name, manufactured by: Okada Seiko Co., Ltd.)

Hereinafter, the external additive contained in the toner of the present invention will be described.

The toner of the present invention contains silica particles as the external additive. As another external additive other than the silica particles, the toner may contain particles that are widely and generally an inorganic or organic material. When the toner contains another external additive other than the silica particles, the total content of the external additives is preferably from 1.2 parts by mass to 4.5 parts by mass, more preferably from 1.6 parts by mass to 3.5 parts by mass, and even more preferably from 2.0 parts by mass to 3.0 parts by mass, with respect to 100 parts by mass of the colored resin particles. The silica particles and so on contained in the toner of the present invention as the external additives, include silica particles and so on that are liberated from the surface of the colored resin particles and exist.

In the present invention, the total content of the silica particles is from 0.5 part by mass to 4.5 parts by mass, preferably from 1.2 parts by mass to 3.8 parts by mass, and more preferably from 1.6 parts by mass to 2.8 parts by mass, with respect to 100 parts by mass of the colored resin particles.

When the total content of the silica particles is less than 0.5 part by mass, the toner may be left untransferred. On the other hand, when the total content of the silica particle is more than 4.5 parts by mass, fog may occur.

In the present invention, the silica particles contain at least silica particles A having a number average particle diameter of from 5 nm to 30 nm. When the number average particle diameter of the silica particles A is less than 5 nm, the silica particles A are likely to penetrate from the surface of the colored resin to the inside thereof, and the printing durability of the toner may decrease. On the other hand, when the number average particle diameter of the silica particles A is more than 30 nm, the toner particles cannot obtain sufficient flowability, and the printing durability of the toner may decrease.

The number average particle diameter of the silica particles A is preferably from 7 nm to 25 nm, and more preferably from 14 nm to 22 nm.

The silica particles A may be composed of one kind of silica particles, or they may be composed of two or more kinds of silica particles having number average particle diameters in the above range.

The silica particles A are preferably colloidal silica particles.

The number average particle diameter of the silica particles used in the present invention can be measured as follows, for example.

First, the particle diameter of each particle of the external additive is measured by means of a transmission electron Microscope (TEM), a scanning electron microscope (SEM) or the like. The particle diameters of at least 30 particles are measured in this manner, and the average is determined as the number average particle diameter of the particles.

As another method for measuring the number average particle diameter of the silica particles used in the present invention, the following method can be exemplified: the silica particles are dispersed in a dispersion medium such as water, and the resulting dispersion is measured by means of a particle size analyzer (product name: MICROTRAC 3300EXII, manufactured by: Nikkiso Co., Ltd.) or the like, thereby measuring the number average particle diameter.

The content of the silica particles A is preferably from 0.1 part by mass to 2.0 parts by mass, more preferably from 0.2 part by mass to 1.8 parts by mass, and even more preferably from 0.4 part by mass to 1.4 parts by mass, with respect to 100 parts by mass of the colored resin particles.

When the content of the silica particles A is less than 0.1 part by mass, the flowability of the toner decreases, and the printing durability of the toner may decrease. On the other hand, when the content of the silica particles A is more than 2.0 parts by mass, the silica particles A are likely to be liberated from the surface of the colored resin particles. As a result, the charge amount of the toner decreases, and fog may occur.

In the present invention, the silica particles contain at least silica particles B having a number average particle diameter of from 31 nm to 100 nm. When the number average particle diameter of the silica particles B is less than 31 nm, the silica particles B are likely to penetrate from the surface of the colored resin particles to the inside thereof, and the printing durability of the toner may decrease. On the other hand, when the number average particle diameter of the silica particles B is more than 100 nm, the silica particles B are likely to be liberated from the surface of the colored resin particles. As a result, the charge amount of the toner decreases, and fog may occur.

The number average particle diameter of the silica particles B is preferably from 35 nm to 80 nm, and more preferably from 40 nm to 70 nm.

The silica particles B may be composed of one kind of silica particles, or they may be composed of two or more kinds of silica particles having number average particle diameters in the above range.

The silica particles B are preferably colloidal silica particles.

The content of the silica particles B is preferably from 0.3 part by mass to 2.5 parts by mass, more preferably from 0.3 part by mass to 2.1 parts by mass, and even more preferably from 0.6 part by mass to 1.8 parts by mass, with respect to 100 parts by mass of the colored resin particles.

When the content of the silica particles B is less than 0.3 part by mass, the flowability of the toner decreases, and the printing durability of the toner may decrease. On the other hand, when the content of the silica particles B is more than 2.5 parts by mass, the silica particles B are likely to be liberated from the surface of the colored resin particles. As a result, the charge amount of the toner decreases, and fog may occur.

As the silica particles A, various kinds of commercially-available products can be used. As the silica particles A, examples include HDK2150 (product name, number average primary particle diameter: 12 nm) manufactured by Clariant Corporation; NA130Y (product name, number average primary particle diameter: 20 nm), R504 (product name, number average primary particle diameter: 12 nm) and RA200HS (product name, number average primary particle diameter: 12 nm), all manufactured by Nippon Aerosil Co., Ltd.; MSP-012 (product name, number average primary particle diameter: 16 nm) and MSP-013 (product name, number average primary particle diameter: 12 nm), both manufactured by Tayca Corporation; and TG-7120 (product name, number average primary particle diameter: 20 nm) manufactured by Cabot Corporation.

As the silica particles B, various kinds of commercially-available products can be used. As the silica particles B, examples include VPNA50H (product name, number average primary particle diameter: 40 nm) and NA50Y (product name, number average primary particle diameter: 35 nm), both manufactured by Nippon Aerosil Co., Ltd.; HDK H05TA (product name, number average primary particle diameter: 50 nm) and HDK H05TX (product name, number average primary particle diameter: 50 nm), both manufactured by WACKER; and TG-C321 (product name, number average primary particle diameter: 70 nm) manufactured by Cabot Corporation.

4. Toner of the Present Invention

For the toner of the present invention, the liberation rate of the silica particles calculated by the following liberation rate measuring method is in a range of from 2.2% to 9.5%.

[Liberation Rate Measuring Method]

Using an airflow classifier such as MULTI PLEX 100MZR (product name, manufactured by: Alpine), a toner to be measured is classified to separate liberated silica particles from the toner; using a X-ray fluorescence spectrometer, the fluorescent X-ray intensity of a Si element in the toner before the classification and that of the Si element in the toner after the classification, are measured; and using measured values thus obtained, the liberation rate of the silica particles in the toner is calculated by the following formula (1):

The liberation rate of the silica particles=[(the fluorescent X-ray intensity of the Si element in the toner before the classification−the fluorescent X-ray intensity of the Si element in the toner after the classification)/the fluorescent X-ray intensity of the Si element in the toner before the classification]×100 Formula (1)

When the liberation rate is less than 2.2%, the flowability of the toner decreases due to penetration of the silica particles, and the printing durability of the toner may decrease. When the liberation rate is more than 9.5%, the silica particles are likely to be liberated from the surface of the toner particles. As a result, the charge amount of the toner decreases, and fog may occur.

The liberation rate of the silica particles is preferably in a range of from 2.5% to 9.0%, and more preferably in a range of from 3.5% to 8.5%.

The toner of the present invention obtained by the above-described processes, which has a liberation rate in the above range, is a toner configured to inhibit toner ejection from a cartridge and occurrence of fog under a high-temperature and high-humidity environment.

EXAMPLES

Hereinafter, the present invention will be described further in detail, with reference to examples and comparative examples. However, the scope of the present invention may not be limited to the following examples. Herein, "part(s)" and "%" are based on mass if not particularly mentioned.

Test methods carried out in the examples and the comparative examples are as follows.

1. Production of Colored Resin Particles 1-1. Preparation of Polymerizable Monomer Composition for Core First, 73 parts of styrene, 27 parts of n-butyl acrylate, 0.6 part of divinylbenzene as polymerizable monomers and 1 part of tetraethylthiuram disulfide, and 8 parts of a magenta colorant (C.I. Pigment Red 122) were dispersed by means of an in-line type emulsifying and dispersing machine (product name: MILDER MDN303V, manufactured by: Pacific Machinery & Engineering Co., Ltd.), thereby obtaining a polymerizable monomer mixture.

To the polymerizable monomer mixture, 2 parts of a charge control resin (product name: ACRYBASE FCA-161P, manufactured by: Fujikura Kasei Co., Ltd.) and 9 parts of a polyol fatty acid ester were added as a charge control agent and a release agent, respectively. They were mixed and dissolved to prepare a polymerizable monomer composition.

1-2. Preparation of Aqueous Dispersion Medium

An aqueous solution of 7.3 parts of sodium hydroxide (alkali metal hydroxide) dissolved in 50 parts of ion-exchanged water, was gradually added to, while agitating at room temperature, an aqueous solution of 10.4 parts of magnesium chloride (water-soluble polyvalent metal salt) dissolved in 280 parts of ion-exchanged water, thereby preparing a magnesium hydroxide colloid (hardly water-soluble metal hydroxide colloid) dispersion.

1-3. Preparation of Polymerizable Monomer for Shell

First, 2 parts of methyl methacrylate and 130 parts of ion-exchanged water were mixed and finely dispersed by means of an ultrasonic emulsifying machine, thereby preparing an aqueous dispersion of a polymerizable monomer for shell.

1-4. Droplets Forming Process

The polymerizable monomer composition was added to the magnesium hydroxide colloid dispersion, and the mixture was agitated at room temperature. Next, 4.0 parts of t-butylperoxy-2-ethylhexanoate was added thereto as a polymerization initiator. Then, using the in-line type emulsifying and dispersing machine (product name: MILDER MDN303V, manufactured by: Pacific Machinery & Engineering Co., Ltd.), the mixture was dispersed by high-speed shearing and agitation at a rotational frequency of 15,000 rpm, thereby forming the polymerizable monomer composition into droplets.

1-5. Suspension Polymerization Process

A suspension thus obtained in which the droplets of the polymerizable monomer composition were dispersed (a polymerizable monomer composition dispersion) was put in a reactor furnished with stirring blades, and the temperature thereof was increased to 90° C. to initiate a polymerization reaction. When a polymerization conversion rate reached almost 100%, the aqueous dispersion of the polymerizable monomer for shell in which, as a polymerization initiator for shell, 0.3 part of 2,2'-azobis(2-methyl-N-(2-hydroxyethyl)-propionamide) (product name: VA-086, manufactured by: Wako Pure Chemical Industries, Ltd., water-soluble) was dissolved, was added to the reactor. The reaction was continued for 4 hours at 95° C. Then, the reaction was stopped by water-cooling the reactor, thereby obtaining an aqueous dispersion of colored resin particles having a core-shell type structure.

1-6. Post-Treatment Processes

The aqueous dispersion of the colored resin particles was subjected to acid washing in the following manner. While agitating the aqueous dispersion, sulfuric acid was added thereto in a dropwise manner at 25° C. for 10 minutes, until the pH of the aqueous dispersion reached 4.5 or less. Next, the aqueous dispersion was subjected to filtration separation. Then, 1 part of a solid matter thus obtained was mixed with 500 parts of ion-exchanged water, re-slurried and then subjected to a water washing treatment (washing, filtering and dehydrating). At this time, the filtrate had an electrical conductivity of 20 μS/cm. Next, a solid matter thus obtained was put in the container of a dryer and dried at 40° C. for 24 hours, thereby obtaining dried colored resin particles (Dv: 5.9 μm, Dv/Dn: 1.12).

2. Production of Toner

Reference Example 1

To 100 parts of the colored resin particles obtained above, silica particles A (composed of 0.2 part of hydrophobized silica particles having a number average particle diameter of 7 nm and 1.1 parts of hydrophobized silica particles having a number average particle diameter of 20 nm) and silica particles B (composed of 1.4 parts of hydrophobized silica particles having a number average particle diameter of 50 nm) were added. Using a high-speed agitator (product name: FM MIXER, manufactured by: Nippon Coke & Engineering Co., Ltd.), they were mixed at a peripheral speed of 68 m/s for 11 minutes, thereby preparing the magenta toner of Reference Example 1.

Example 2

The toner of Example 2 was obtained in the same manner as Reference Example 1, except that the peripheral speed was changed to 40 m/s in the attachment.

Example 3

The toner of Example 3 was obtained in the same manner as Reference Example 1, except that the peripheral speed and the time were changed to 40 m/s and 22 minutes in the attachment, respectively.

Comparative Example 1

The toner of Comparative Example 1 was obtained in the same manner as Reference Example 1, except that the time was changed to 22 minutes in the attachment.

Comparative Example 2

The toner of Comparative Example 2 was obtained in the same manner as Reference Example 1, except that the peripheral speed and the time were changed to 40 m/s and 6 minutes in the attachment, respectively.

3. Evaluation of Characteristics of Toners and Colored Resin Particles

The characteristics of the toners of Examples 1 to 3 and Comparative Examples 1 and 2, and the characteristics of the colored resin particles used in the toners were examined. The details are as follows.

<1> Measurement of Volume Average Particle Diameter Dv of Colored Resin Particles The volume average particle diameter Dv of the colored resin particles was measured by means of MULTISIZER (product name, manufactured by: Beckman Coulter, Inc.) This measurement using the MULTISIZER was carried out in the following conditions:

Aperture diameter: 100 μm

Medium: ISOTON II (product name, manufactured by: Beckman Coulter, Inc.)

Concentration: 10%

Number of measured particles: 100,000 particles

<2> Measurement of Liberation Rate

Using an airflow classifier (product name: MULTI PLEX 100MZR, manufactured by: Alpine), in the conditions of a suctioned air amount of 34 $m^3$/h and a rotational frequency of 13000 rpm, each of the toners of Examples and Comparative Examples was classified to separate liberated silica particles from the toner; using a X-ray fluorescence spectrometer (product name: ZSX PRIMUS, manufactured by: Rigaku Corporation), the fluorescent X-ray intensity of a Si element in the toner before the classification and that of the Si element in the toner after the classification, were measured; and using measured values thus obtained, the liberation rate of the silica particles in the toner was calculated by the following formula (1):

The liberation rate of the silica particles=[(the fluorescent X-ray intensity of the Si element in the toner before the classification−the fluorescent X-ray intensity of the Si element in the toner after the classification)/the fluorescent X-ray intensity of the Si element in the toner before the classification]×100 Formula (1)

<3> Ejection Test

In the ejection test, a commercially-available, non-magnetic one-component development printer (print rate: 20 sheets/min) was used. The toner was packed in the toner cartridge of a development device. The toner cartridge was left under a normal-temperature and normal-humidity (N/N) environment (temperature: 23° C., humidity: 50%) for one day. The cartridge and printing paper sheets were loaded in the printer. Then, continuous printing was carried out.

The continuous printing was carried out under a normal-temperature and normal-humidity (N/N) environment (temperature: 23° C., humidity: 50%). In particular, halftone printing was carried out on 5 printing paper sheets at an image density of 30%. Then, it was checked if there was a spot with a size of 0.3 mm×0.3 mm or larger on the halftone or not, which was produced by the toner ejected from the toner cartridge onto the printing paper sheets. When such a spot was found, the number of sheets having 0 spots was checked.

<4> Initial Fog Test Under High-Temperature and High-Humidity (H/H) Environment

Printing paper sheets were loaded in the non-magnetic one-component development printer used in the ejection test. The toner was packed in the toner cartridge of the development device. The toner cartridge was left under a normal-temperature and normal-humidity (N/N) environment (temperature: 23° C., humidity: 50%) for one day. Then, fog measurement was carried out under a high-temperature and high-humidity (H/H) environment (temperature: 30° C., humidity: 80% RH).

The fog measurement was carried out by the following method. First, the hue of a paper sheet not used for printing, was measured and determined as a reference value (E0). Next, using the toner to be measured, a solid pattern with 0% image density was printed by the printer. The hues (E1 to E6) of 6 points on the solid pattern were measured. The differences (ΔE) between the reference value (E0) and the hues (E1 to E6) were calculated, and the largest ΔE was determined as the fog value of the toner. A smaller fog value means less fog and better printing. In this evaluation, when the fog value was 1.0 or less, the toner was determined as being successfully usable as a toner.

For the hue measurement, a spectrophotometer (product name: SPECTROEYE, manufactured by: GretagMacbeth) was used.

Table 1 shows the measurement and evaluation results of the toners of Examples 1 to 3 and Comparative Examples 1 and 2. In the following Table 1, "HH fog" means an initial fog value under the high-temperature and high-humidity (H/H) environment in the initial fog test. Also, "Content of silica particles A" is the sum of the amount (0.2 part) of the hydrophobized silica fine particles having an average particle diameter of 7 nm and the amount (1.1 parts) of the hydrophobized silica fine particles having an average particle diameter of 20 nm.

TABLE 1

| | Example 1 | Example 2 | Example 3 | Comparative Example 1 | Comparative Example 2 |
|---|---|---|---|---|---|
| Particle diameter of colored resin particles (μm) | 5.9 | 5.9 | 5.9 | 5.9 | 5.9 |
| Content of silica particles A | 1.30 | 1.30 | 1.30 | 1.30 | 1.30 |
| Content of silica particles B | 1.40 | 1.40 | 1.40 | 1.40 | 1.40 |
| Peripheral speed (m/s) | 68 | 40 | 40 | 68 | 40 |
| Time for attachment (min) | 11 | 11 | 22 | 22 | 6 |
| Liberation rate (%) | 2.7 | 8.0 | 4.8 | 0.3 | 13.5 |
| Printing evaluation | | | | | |
| Ejection evaluation (sheets) | 5 | 0 | 0 | 20 | 20 |
| HH fog | 0.4 | 0.6 | 0.5 | 2.0 | 4.1 |

4. Conclusion from Toner Evaluation

Hereinafter, the toner evaluation will be discussed with reference to Table 1.

According to Table 1, for the toner of Comparative Example 1, the number of the ejection evaluation sheets is 20 sheets and large, and the HH fog value is 2.0 and high. For the toner of Comparative Example 1, since the liberation rate is 0.3% and low, it is thought that toner ejection and fog under the high-temperature and high-humidity environment are likely to occur.

Also, for the toner of Comparative Example 2, the number of the ejection evaluation sheets is 20 sheets and large, and the HH fog value is 4.1 and high. For the toner of Comparative Example 2, since the liberation rate is 13.5% and high, it is thought that toner ejection and fog under the high-temperature and high-humidity environment are likely to occur.

From the above results, for the toners of Comparative Examples 1 and 2 for which the liberation rate of the silica particles is outside a range of from 2.2% to 9.5%, it is revealed that toner ejection from the toner cartridge and fog under the high-temperature and high-humidity environment are likely to occur.

Meanwhile, according to Table 1, for the toners of Examples 1 to 3 having a liberation rate of from 2.7% to 8.0%, the number of the ejection evaluation sheets is 5 sheets or less, and the HH fog value is 0.6 or less and low. In the toners of Examples 1 to 3 for which the liberation rate is in an appropriate range of from 2.7% to 8.0%, the state of attachment of the external additive to the colored resin particles is excellent. Therefore, it is thought that toner ejection and occurrence of fog under the high-temperature and high-humidity environment, are inhibited.

From the above results, the following is revealed: the toners of Examples 1 to 3, which are toners for developing electrostatic images, comprising the colored resin particles containing the binder resin and the magenta colorant, and the external additive, wherein the volume average particle diameter of the colored resin particles is from 5.5 μm to 7.0 μm; wherein the external additive contains the silica particles; wherein the silica particles contain at least the silica particles A having a number average particle diameter of from 5 nm to 30 nm and the silica particles B having a number average particle diameter of from 31 nm to 100 nm; wherein the content of the silica particles is from 0.5 part by mass to 4.5 parts by mass, with respect to 100 parts by mass of the colored resin particles; and wherein the liberation rate of the silica particles calculated by the above-mentioned liberation rate measuring method is in a range of from 2.2% to 9.5%, are toners configured to inhibit toner ejection from a cartridge and occurrence of fog under a high-temperature and high-humidity environment.

The invention claimed is:

1. A magenta toner for developing electrostatic images, comprising colored resin particles containing a binder resin and a magenta colorant, and an external additive, wherein a volume average particle diameter of the colored resin particles is from 5.5 μm to 7.0 μm;

wherein the external additive contains silica particles;

wherein the silica particles contain at least silica particles A having a number average particle diameter of from 5 nm to 30 nm and silica particles B having a number average particle diameter of from 31 nm to 100 nm;

wherein a total content of the silica particles is from 0.5 part by mass to 4.5 parts by mass, with respect to 100 parts by mass of the colored resin particles; and wherein a liberation rate of the silica particles calculated by the following liberation rate measuring method is in a range of from 3.5% to 9.5%:

[liberation rate measuring method]

using an airflow classifier, in the conditions of a suctioned air amount of 34 $m^3/h$ and a rotational frequency of 13000 rpm, a toner to be measured is classified to separate liberated silica particles from the toner; using a X-ray fluorescence spectrometer, a fluorescent X-ray intensity of a Si element in the toner before the classification and that of the Si element in the toner after the classification, are measured; and using measured values thus obtained, a liberation rate of the silica particles in the toner is calculated by the following formula (1):

The liberation rate of the silica particles=[(the fluorescent X-ray intensity of the Si element in the toner before the classification−the fluorescent X-ray intensity of the Si element in the toner after the classification)/the fluorescent X-ray intensity of the Si element in the toner before the classification]×100 Formula (1).

2. A magenta toner for developing electrostatic images according to claim 1, wherein a content of the silica particles A is from 0.1 part by mass to 2.0 parts by mass, with respect to 100 parts by mass of the colored resin particles.

3. A magenta toner for developing electrostatic images according to claim 1, wherein a content of the silica particles B is from 0.3 part by mass to 2.5 parts by mass, with respect to 100 parts by mass of the colored resin particles.

* * * * *